US007877041B2

(12) United States Patent
Kotsuka et al.

(10) Patent No.: US 7,877,041 B2
(45) Date of Patent: Jan. 25, 2011

(54) IMAGE FORMING APPARATUS WITH EXPOSURE SUPPORT MEMBER

(75) Inventors: Hideki Kotsuka, Suntou-gun (JP); Takayuki Kato, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 355 days.

(21) Appl. No.: 12/123,442

(22) Filed: May 19, 2008

(65) Prior Publication Data

US 2008/0310879 A1 Dec. 18, 2008

(30) Foreign Application Priority Data

Jun. 18, 2007 (JP) ..... 2007-160033

(51) Int. Cl.
*G03G 15/00* (2006.01)

(52) U.S. Cl. ..... 399/118

(58) Field of Classification Search ..... 399/107, 399/112, 118; 347/138, 152, 245, 257, 263
See application file for complete search history.

(56) References Cited

U.S. PATENT DOCUMENTS

| | | | | |
|---|---|---|---|---|
| 6,393,234 | B1 | 5/2002 | Tashiro | 399/107 |
| 6,636,338 | B1 * | 10/2003 | Kida et al. | 359/196.1 |
| 7,177,566 | B2 * | 2/2007 | Noda et al. | 399/107 |
| 7,333,749 | B2 * | 2/2008 | Noguchi et al. | 399/107 |
| 7,356,283 | B2 * | 4/2008 | Igarashi | 399/111 |
| 7,436,417 | B2 * | 10/2008 | Sato et al. | 347/138 |
| 7,446,910 | B2 * | 11/2008 | Tamaru | 358/474 |
| 7,483,648 | B2 * | 1/2009 | Hosokawa et al. | 399/107 |
| 2007/0230995 | A1 * | 10/2007 | Yokota et al. | 399/107 |

FOREIGN PATENT DOCUMENTS

| | | |
|---|---|---|
| JP | 2001-66840 | 3/2001 |
| JP | 2002-287453 | 10/2002 |
| JP | 2005-173455 | 6/2005 |

OTHER PUBLICATIONS

Korean Office Action dated Sep. 29, 2009, from corresponding Korean Application No. 10-2008-0056591.

* cited by examiner

*Primary Examiner*—Robert Beatty
(74) *Attorney, Agent, or Firm*—Fitzpatrick, Cella, Harper & Scinto

(57) ABSTRACT

The image forming apparatus including an exposure unit that exposes an image bearing member by a laser beam, a first side plate and a second side plate facing with each other, and a first support member, a second support member, and a third support member connecting the first side plate and the second side plate to each other, wherein the first side plate and the second side plate and the first support member, the second support member, and the third support member form a substantially closed space, with said exposure unit being arranged in the closed space, and wherein a section of the closed space on a plane parallel to the first side plate and the second side plate has a substantially triangular shape. It achieves preventing the displacement of an optical component attributable to an increase in size of the image forming apparatus main body and twisting of side plates.

2 Claims, 9 Drawing Sheets

IMAGE FORMING APPARATUS WITH EXPOSURE SUPPORT MEMBER

BACKGROUND OF THE INVENTION

1. Field of the Invention

The present invention relates to an image forming apparatus such as a copying machine or a laser beam printer adopting an electrophotographic system, in particular, a frame construction of an apparatus main body.

2. Description of the Related Art

With regard to an image forming apparatus adopting an electrophotographic system, there has been proposed a construction in which rigidity of a frame of an apparatus main body (hereinafter referred to as main body frame) is enhanced for the purpose of performing image formation of higher image quality. When the rigidity of the main body frame is low, positional deviation of optical components such as the photosensitive drum and the laser scanner arranged within the main body frame is caused by the influence of vibration, etc. at the time of driving of the apparatus main body, resulting in image failure such as image distortion or misregistration.

FIG. 9 schematically illustrates a construction of the main body frame of a conventional image forming apparatus. As illustrated in FIG. 9, the conventional main body frame is equipped with a front side plate 50 and a rear side plate 51 formed by sheet metal stamping through press working; between the two side plates, there are provided support members 52, 53, 54, and 55 and, further, reinforcing members 56 and 57. The support members 52, 53, 54, and 55 are fastened to the side plates by screws or welding.

However, in a recent image forming apparatus, of which high image quality performance is required, the above-mentioned conventional main body frame is rather inadequate in terms of rigidity, thus a high quality image cannot be formed on a sheet material. If, in order to enhance the rigidity of the main body frame, a reinforcing member is provided in the main body frame or the thickness of each member constituting the main body frame is increased, the production cost of the main body frame is increased.

In this regard, Japanese Patent Application Laid-Open No. 2001-66840 discloses a construction in which the rigidity of the main body frame is enhanced by forming a box-shaped closed space at the bottom of the main body frame by a support member mounted between a front side plate and a rear side plate.

With this construction, there is no need to provide a reinforcing member on the main body frame, so it is possible to enhance the rigidity of the main body frame while suppressing an increase in production cost.

However, when a box-shaped closed space is formed at the bottom of the main body frame as in the case of the above-mentioned conventional example, the interior of the closed space constitutes a dead space, resulting in an increase in size of the apparatus main body.

Further, the front side plate and the rear side plate are twisted with respect to each other around the support member forming the closed space. Thus, in the construction in which the closed space is provided at the bottom of the main body frame, the twisting of the side plates occurs to a large degree at a position spaced apart from the bottom portion of the main body frame.

As a result, when an optical component such as a laser scanner is mounted to the front side plate and the rear side plate at a position spaced apart from the bottom portion of the main body frame, twisting of the side plates causes positional deviation of the optical component, thus a high quality image cannot be obtained.

SUMMARY OF THE INVENTION

An object of the present invention is to provide an image forming apparatus capable of preventing the displacement of an optical component attributable to an increase in size of the image forming apparatus main body and twisting of side plates.

Another object of the present invention to provide an image forming apparatus including an exposure unit that exposes an image bearing member by a laser beam, a first side plate and a second side plate facing with each other, and a first support member, a second support member, and a third support member connecting the first side plate and the second side plate to each other, wherein the first side plate and the second side plate and the first support member, the second support member, and the third support member form a substantially closed space, wherein said exposure unit is arranged in the closed space, and wherein a section of the closed space on a plane parallel to the first side plate and the second side plate has a substantially triangular shape.

A further object of the present invention will become apparent from the following description of exemplary embodiments with reference to the attached drawings.

DESCRIPTION OF THE EMBODIMENTS

In the following, embodiments of the present invention are described in detail with reference to the drawings.

First Embodiment

An image forming apparatus according to the first embodiment of the present invention is described with reference to FIGS. 1 through 4.

(General Construction of Image Forming Apparatus)

Figure 4:
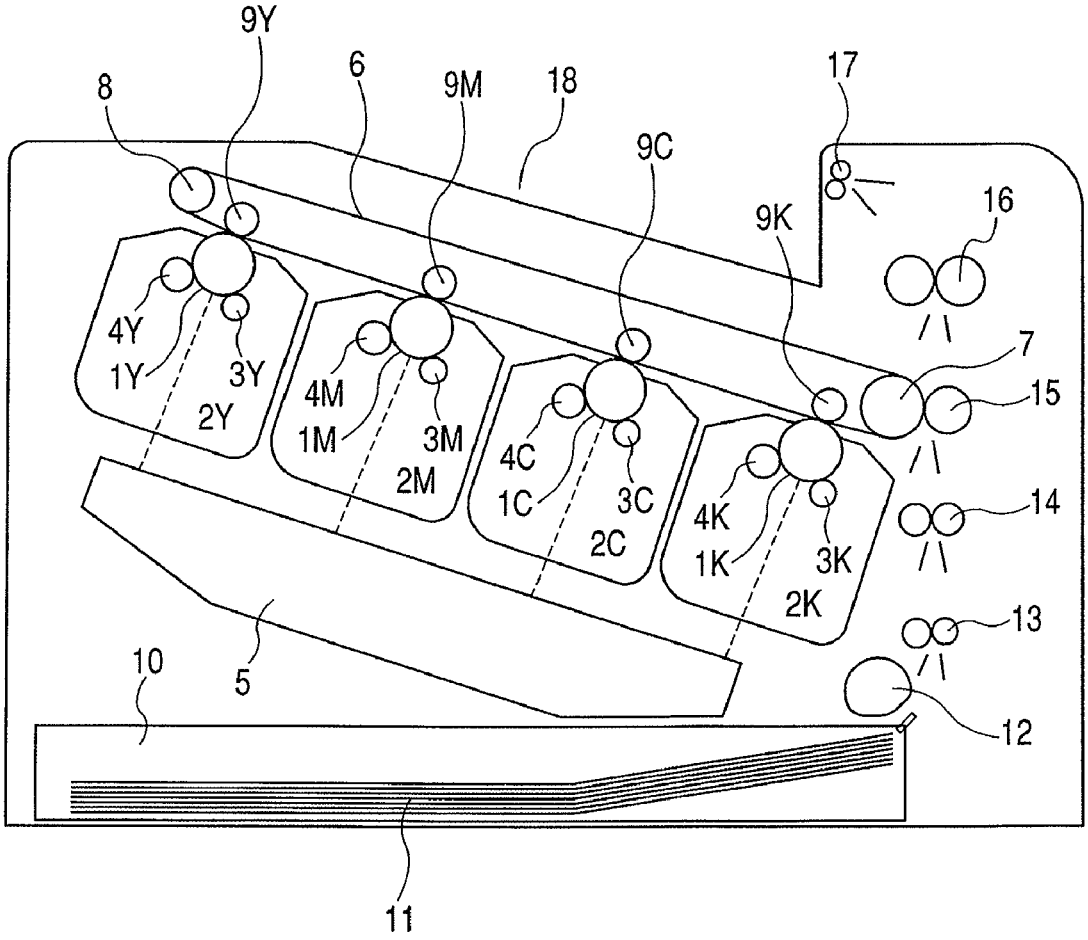
FIG. 4 is a diagram illustrating an image forming apparatus according to the first embodiment.

FIG. 4 schematically illustrates the construction of an image forming apparatus according to this embodiment. The image forming apparatus of this embodiment is equipped with photosensitive drums 1Y, 1M, 1C, and 1K as image bearing members.

The photosensitive drums 1Y, 1M, 1C, and 1K are provided with yellow (Y), magenta (M), cyan (C), and black (K) toner, respectively, and are rotated clockwise as seen in FIG. 4 by a drive motor (not shown). The surfaces of the photosensitive drums 1Y, 1M, 1C, and 1K are coated with organic photoconductive layers.

At positions adjacent to the photosensitive drums 1Y, 1M, 1C, and 1K, there are provided charge rollers 3Y, 3M, 3C, and 3K for charging the surfaces of the photosensitive drums, and developing rollers 4Y, 4M, 4C, and 4K for supplying toner to the surfaces of the photosensitive drums. Further, the photosensitive drums, the charge rollers, and the developing rollers are integrated for the corresponding toners to form process cartridges 2Y, 2M, 2C, and 2K.

When forming an image on a sheet material serving as the recording material, charge bias is applied to the charge rollers to thereby uniformly charge the surfaces of the photosensitive drums. Further, based on image information, laser beams are applied to the photosensitive drums from a laser scanner device 5 provided as the exposure unit, thereby forming electrostatic latent images on the photosensitive drums.

Then, toners are supplied from the developing rollers to the electrostatic latent images formed on the surfaces of the photosensitive drums, and the electrostatic latent images on the photosensitive drums are developed into toner images.

The toner images of the respective colors formed on the photosensitive drums are transferred to an intermediate transferring belt 6 so as to be successively superimposed one upon the other at nip portions between the photosensitive drums and primary transfer rollers 9Y, 9M, 9C, and 9K (primary transfer).

The intermediate transferring belt 6 is stretched between a drive roller 7 and a driven roller 8, and is run counterclockwise as seen in FIG. 4 through rotation of the drive roller 7.

The portions of the intermediate transferring belt 6 to which primary transfer of the toner images has been effected are conveyed to a nip portion between the drive roller 7 and a secondary transfer roller 15 as the intermediate transferring belt 6 runs, and, at this nip portion, the toner images on the intermediate transferring belt 6 are transferred to a sheet material 11 (secondary transfer).

Plural sheet materials 11 are stacked together in a feeding cassette 10. They are fed to a feeding roller 12 driven with a predetermined timing, and are then passed through a conveying roller pair 13 and a registration roller pair 14 to be conveyed to the nip portion between the intermediate transferring belt 6 and the secondary transfer roller 15.

The sheet material 11 to which the toner images have been transferred through secondary transfer is conveyed to a fixing roller pair 16, and, at the nip portion of the fixing roller pair 16, the toner images on the sheet material 11 are heated and pressurized to be thereby fixed to the sheet material 11.

The sheet material 11 to which the toner images have been fixed is conveyed from the fixing roller pair 16 to a discharge roller pair 17, and is discharged onto a discharge tray 18 from the discharge roller pair 17.

(Construction of Main Body Frame)

Figure 1:
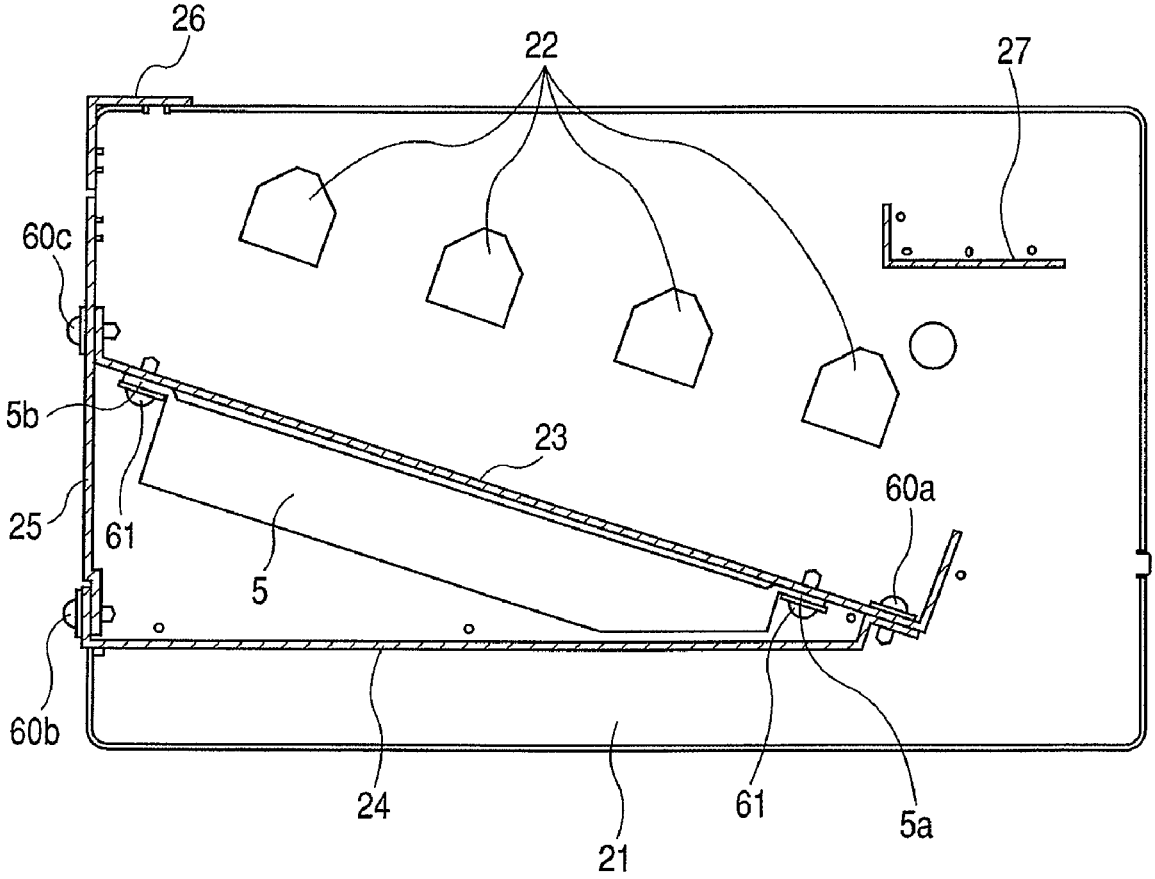
FIG. 1 is a sectional view of a main body frame according to a first embodiment of the present invention.
Figure 2:
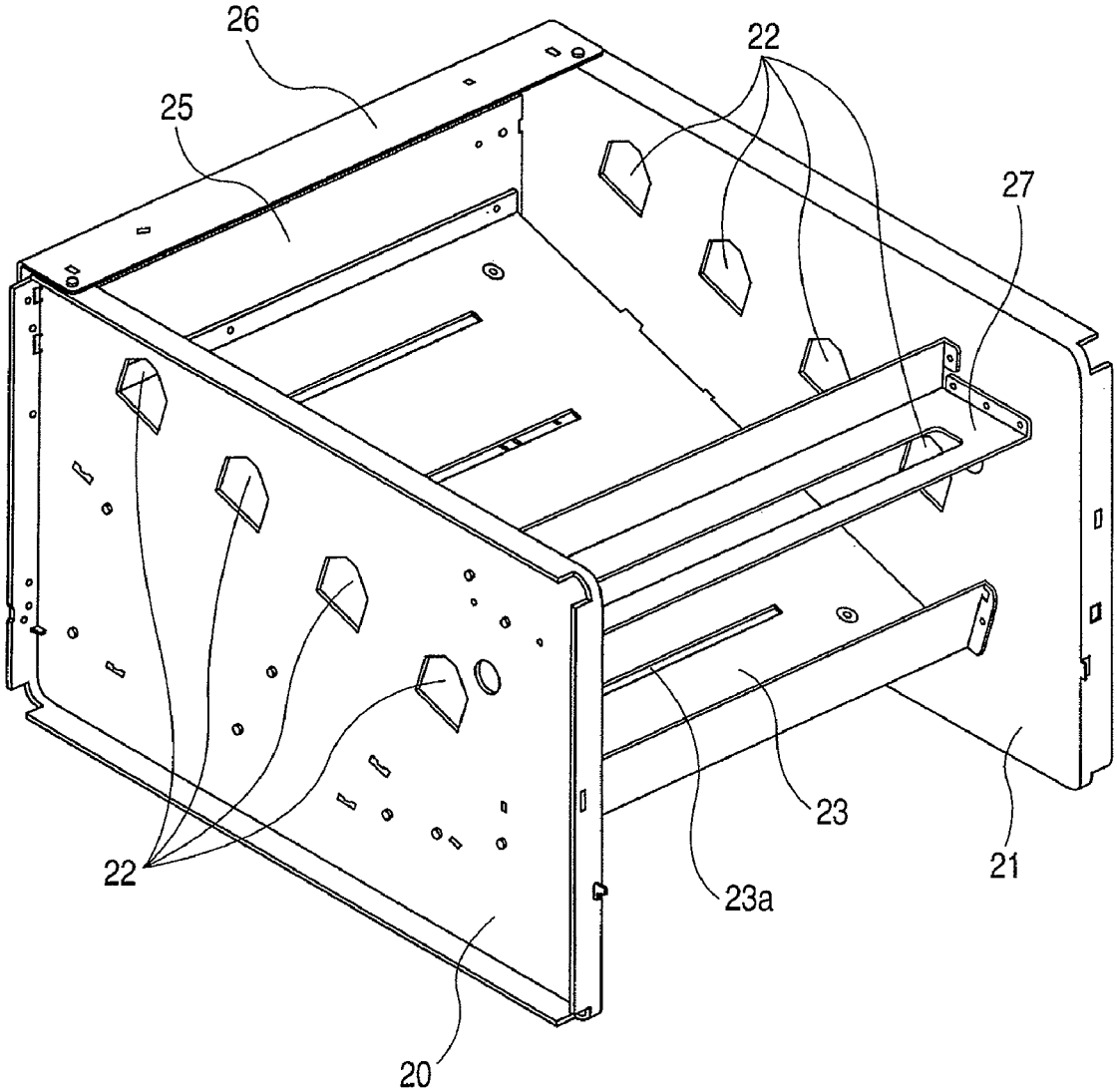
FIG. 2 is a perspective view of the main body frame of the first embodiment.
Figure 3:
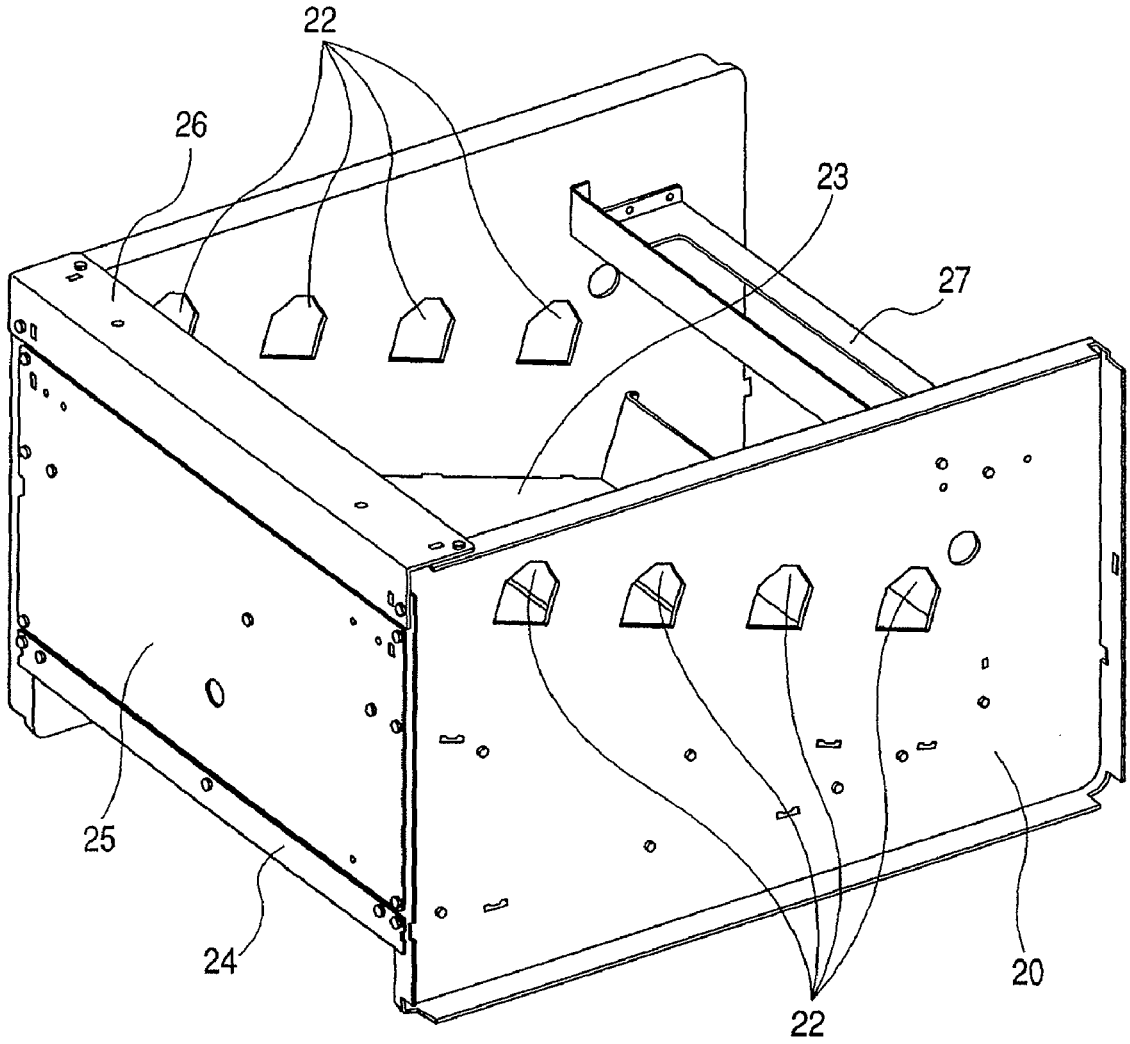
FIG. 3 is a perspective view of the main body frame of the first embodiment.

The main body frame of the image forming apparatus of this embodiment is described with reference to FIGS. 1 through 3. FIGS. 1 through 3 schematically illustrate the construction of the main body frame of this embodiment.

As illustrated in FIGS. 2 and 3, the main body frame of this embodiment is equipped with a front side plate 20 constituting a first side plate and a rear side plate 21 constituting a second side plate; further, between the front side plate 20 and the rear side plate 21, there are provided plate-like support members 23, 24, 25, 26, and 27 connecting the front side plate 20 and the rear side plate 21 to each other. The support members 23 through 27 are fastened to the front side plate 20 and the rear side plate 21 by screws.

In this way, the support members 23 through 27 are connected to the front side plate 20 and the rear side plate 21, thereby determining the positional relationship between the two side plates and securing the rigidity of the main body frame.

Further, the front side plate 20 and the rear side plate 21 have cutout portions 22. The cutout portions 22 are formed at positions corresponding to the process cartridges 2Y, 2M, 2C, and 2K accommodated in the main body frame.

In this embodiment, four process cartridges are provided, so the cut-out portions 22 are provided at four positions in each of the front side plate 20 and the rear side plate 21. Further, in order to achieve a reduction in size of the image forming apparatus, the process cartridges of this embodiment are arranged obliquely with respect to the installment surface of the apparatus main body (see FIG. 4). Thus, the cutout portions 22 are also formed obliquely in the front side plate 20 and the rear side plate 21 so as to be parallel with the direction in which the process cartridges are arranged (see FIG. 1).

Further, the process cartridges are equipped with positioning portions (not shown); by urging the positioning portions by elastic members such as springs, the positioning members can be fit-engaged with the cutout portions 22. That is, both ends of the process cartridges are detachably mounted to the front side plate 20 and the rear side plate 21 at the cutout portions 22.

Further, as illustrated in FIG. 1, in this embodiment, connection is effected between the support member 23 and the support member 24, between the support member 24 and the support member 25, and between the support member 25 and the support member 23 by screws 60*a*, 60*b*, and 60*c*, respectively.

As a result, a substantially closed space is formed within the frame main body by the front side plate 20, the rear side plate 21, the support member (first support member) 23, the support member (second support member) 24, and the support member (third support member) 25. The configuration of the section of the closed space parallel to both side plates is substantially triangular. Further, a laser scanner device 5 as the exposure unit is arranged within the closed space.

The laser scanner device 5 has bearing surfaces 5*a* and 5*b* at its end portions; at the bearing surfaces 5*a* and 5*b*, the laser scanner device 5 is mounted to the inner wall surface of the support member 23 by four screws 61 (see FIG. 1).

As described above, in this embodiment, the front side plate 20 and the rear side plate 21 are connected by multiple plate-like support members, and these support members are connected to each other to form a closed space, whereby it is possible to enhance the rigidity of the main body frame without separately providing a reinforcing member. Further, the configuration of the section of the closed space parallel to both side plates is substantially triangular, whereby it is possible to further enhance the rigidity of the main body frame.

Further, in this embodiment, the laser scanner device 5 is arranged within the closed space formed by the front side plate 20, the rear side plate 21, and the multiple support members, so it is possible to effectively suppress positional deviation of the laser scanner device 5.

That is, the nearer to the portions where the support members are connected, the higher the rigidity of the front side plate and the rear side plate. In particular, the regions of the front side plate and the rear side plate surrounded by the support members forming the closed space exhibit high rigidity. On the other hand, the more spaced apart from the support members, the larger the amount by which the front side plate and the rear side plate are twisted around the support members.

In order to form a high quality image on the sheet material, it is necessary that the exposure accuracy of the laser scanner device 5 provided as the exposure unit be enhanced. Thus, when positional deviation of the laser scanner device 5 occurs due to twisting of the front side plate and the rear side plate, it is impossible to obtain a high quality image.

In view of this, in this embodiment, the laser scanner device 5 as the exposure unit is arranged within the closed space formed by the front side plate and the rear side plate and the multiple support members, whereby it is possible to effectively suppress positional deviation of the laser scanner device 5 attributable to twisting of the front side plate 20 and the rear side plate 21.

With this construction, it is possible to effectively suppress positional deviation of the laser scanner device 5, so it is possible to obtain a high quality image.

Further, since the laser scanner device 5 is provided inside the closed space, the closed space does not constitute a dead space, thus allowing the closed space to be effectively utilized, so it is possible to prevent an increase in size of the image forming apparatus due to the formation of the closed space.

Further, as illustrated in FIG. 2, of the support members forming the closed space, the support member 23 arranged between the laser scanner device 5 and the photosensitive drums to which laser beams are applied is provided with slit portions 23*a* for allowing passage of the laser beams. The laser beams emitted from the laser scanner device 5 pass through the slit portions 23*a* to be applied to the photosensitive drums.

Further, in this embodiment, the support member 23 is arranged so as to be parallel to the direction in which the process cartridges are arranged (i.e., obliquely with respect to the installment surface of apparatus main body) (see FIG. 1). With this construction, no unnecessary space is formed between the process cartridges and the support member 23. Thus, it is possible to achieve a reduction in size of the image forming apparatus main body.

In this way, the arrangement direction, configuration, etc. of the support members forming the closed space are set while taking into consideration the configuration, arrangement direction, etc. of the members arranged outside the closed space, whereby no unnecessary space is generated within the main body frame, so it is possible to prevent an increase in size of the image forming apparatus main body.

While in this embodiment four photosensitive drums are provided as the image bearing members, the number of photosensitive drums is not restricted to four; it is only necessary that at least one photosensitive drum be provided within the apparatus main body.

As described above, according to this embodiment, it is possible to provide an image forming apparatus capable of preventing an increase in size of the image forming apparatus main body and positional deviation of the optical component due to twisting of the side plates while providing a closed space in the main body frame.

Second Embodiment

An image forming apparatus according to the second embodiment of the present invention is described with reference to FIGS. 5 through 8. FIGS. 5 through 8 schematically illustrate the construction of the main body frame of this embodiment; of the drawings, FIG. 7 schematically illustrates the construction of the main body frame of this embodiment with a support member 33 removed therefrom. The general construction of the image forming apparatus is the same as that of the first embodiment described above; here, the description centers on the differences, that is, the construction of the main body frame and, in particular, the method of fixing in position the laser scanner device 5 arranged within the closed space.

(Construction of Main Body Frame)

Figure 6:
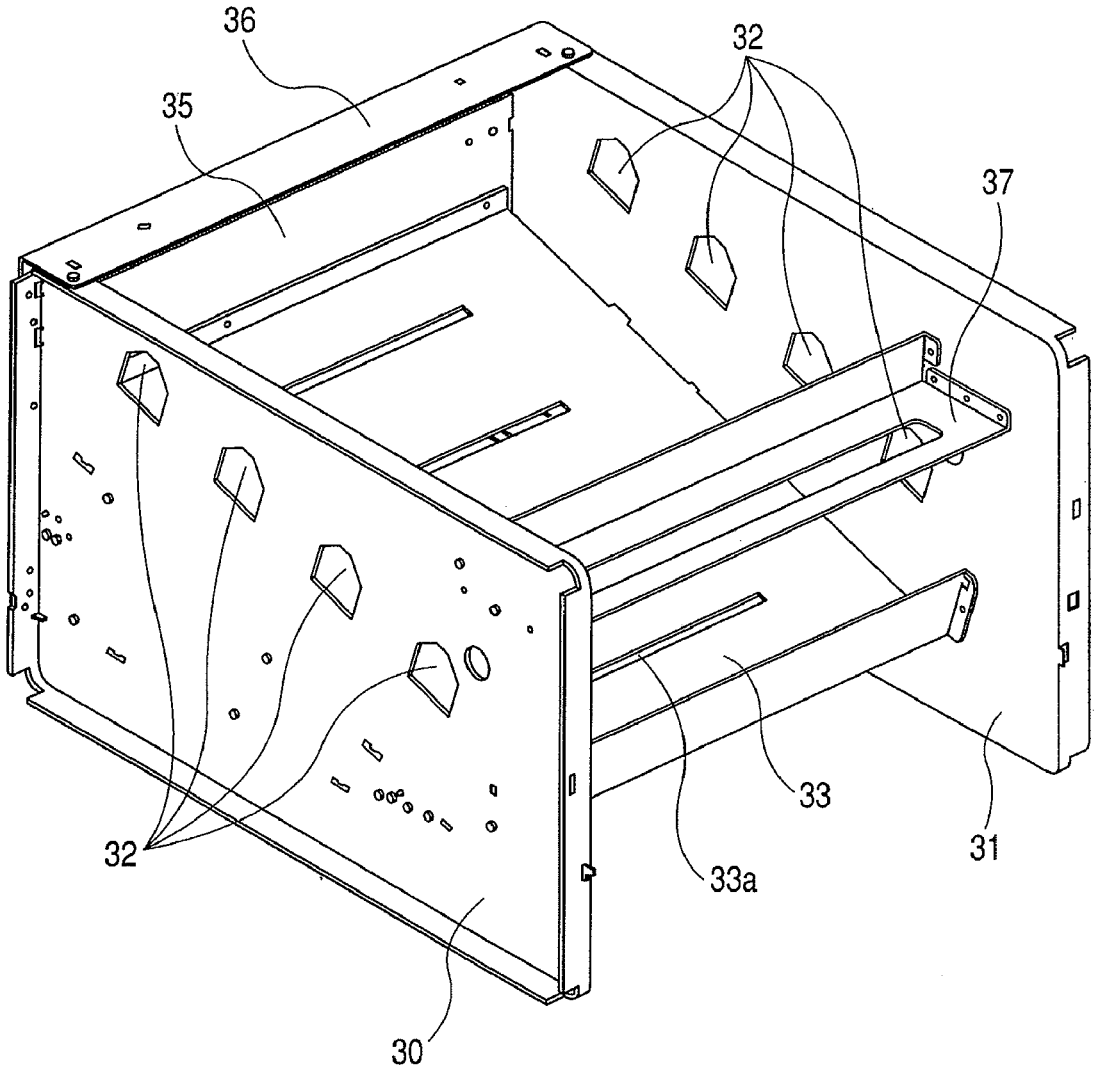
FIG. 6 is a perspective view of the main body frame of the second embodiment.
Figure 7:
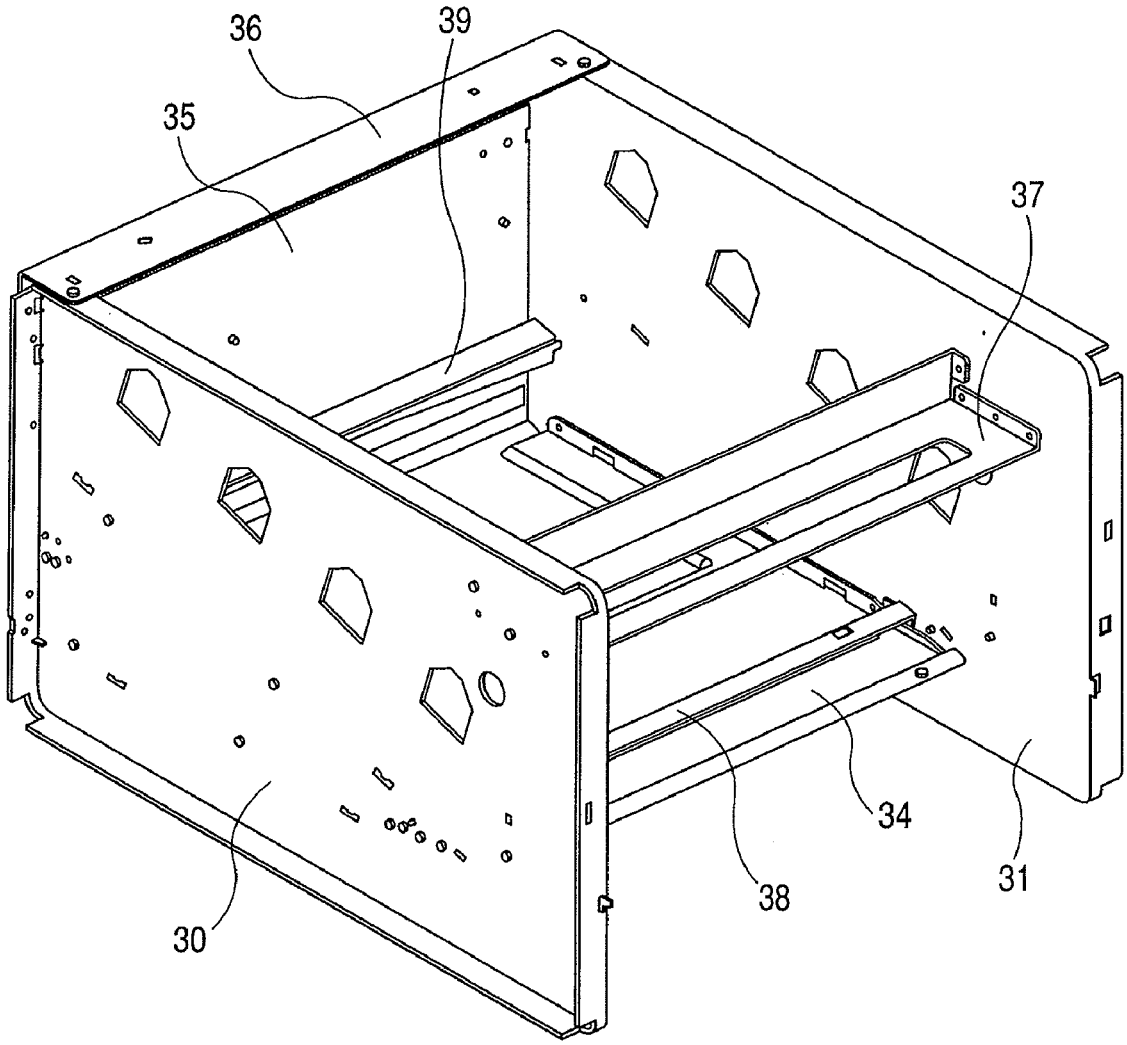
FIG. 7 is a perspective view of the main body frame of the second embodiment.
Figure 8:
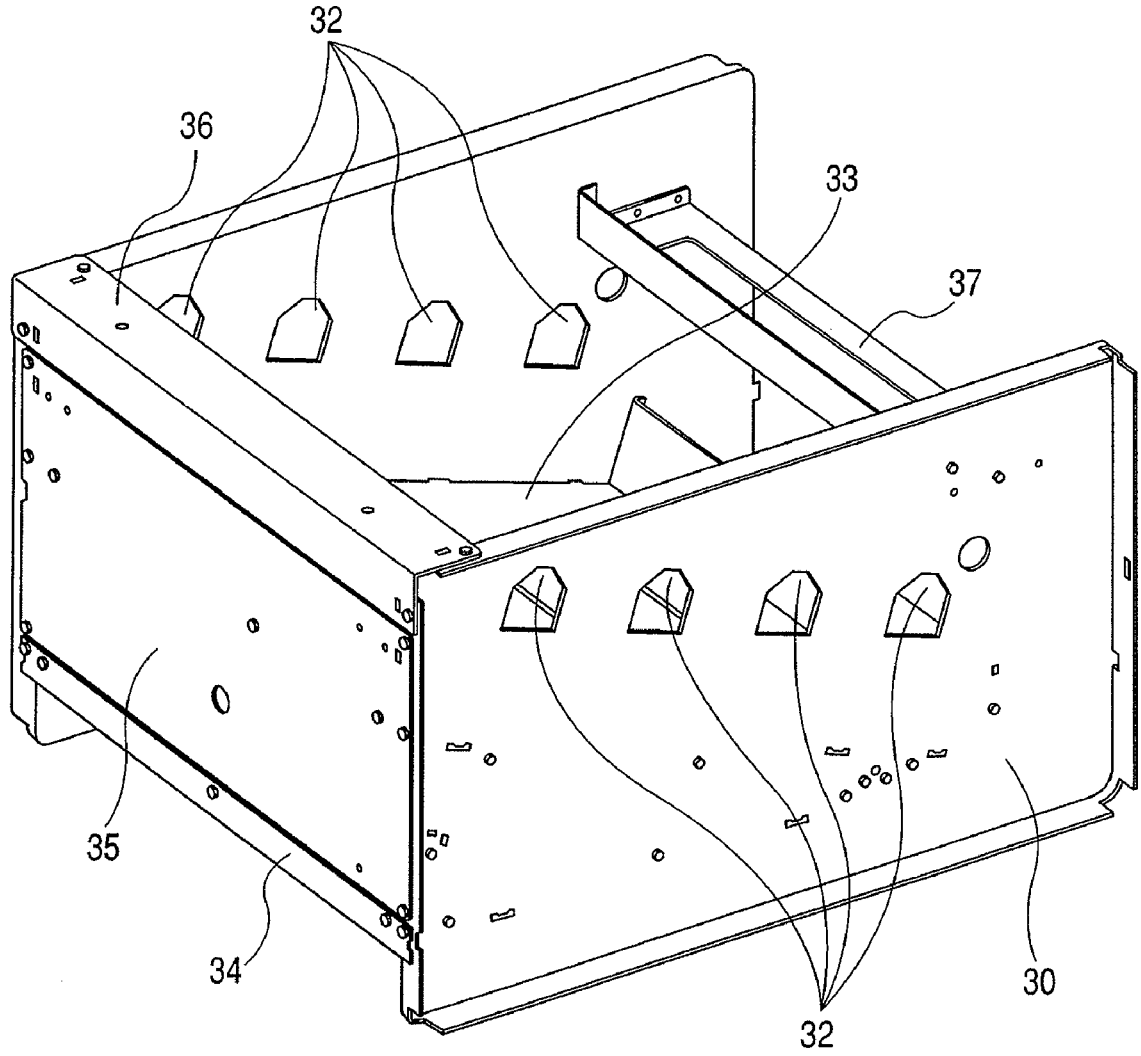
FIG. 8 is a perspective view of the main body frame of the second embodiment.
Figure 9:
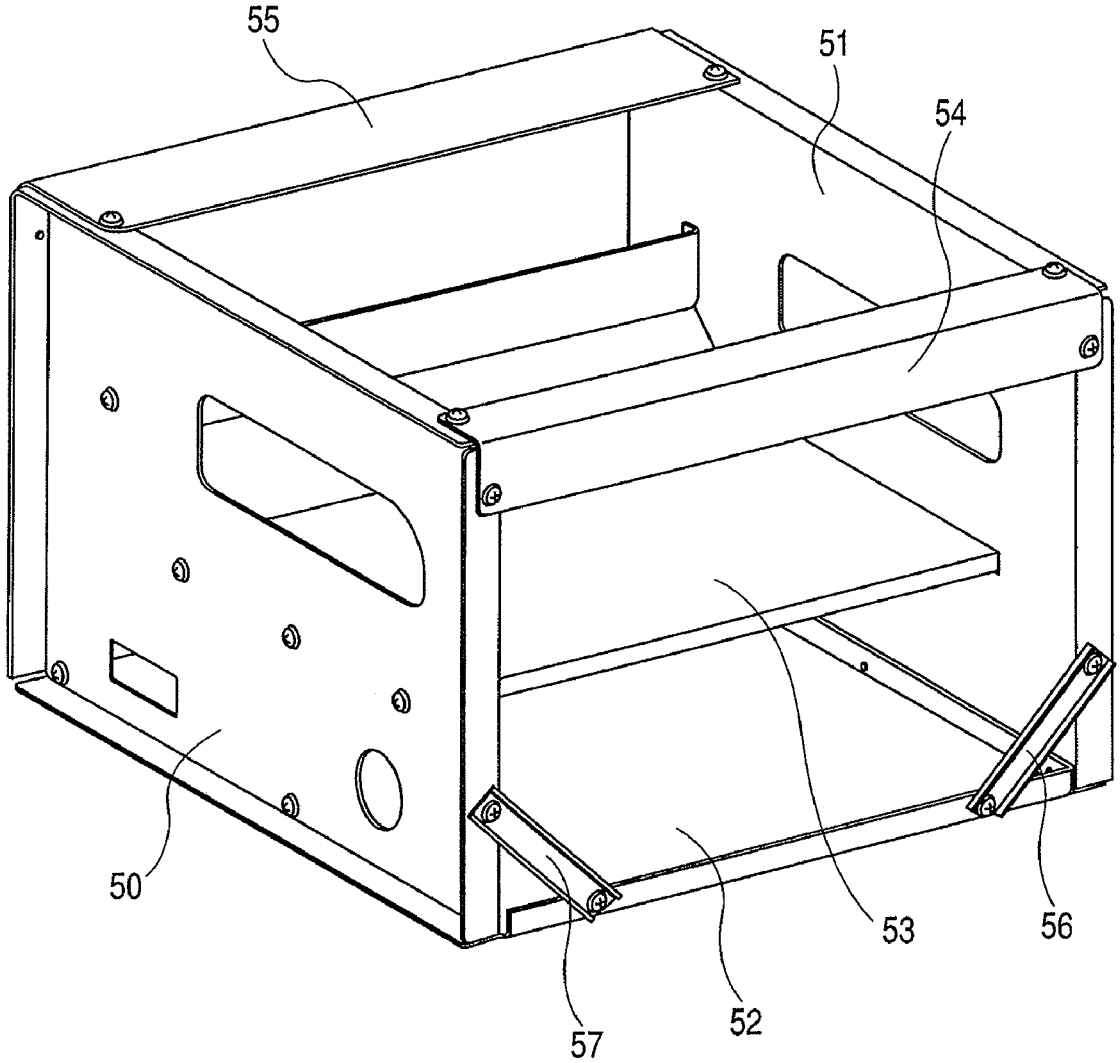
FIG. 9 is a diagram illustrating the main body frame of a conventional image forming apparatus.

As illustrated in FIGS. 6 to 8, the main body frame of this embodiment is equipped with a front side plate 30 and a rear side plate 31 facing each other; further, between the front side plate 30 and the rear side plate 31, there are provided support members 33, 34, 35, 36, and 37 connecting the front side plate 30 and the rear side plate 31 to each other. The support members 33 through 37 are fastened to the front side plate 30 and the rear side plate 31 by screws.

Figure 5:
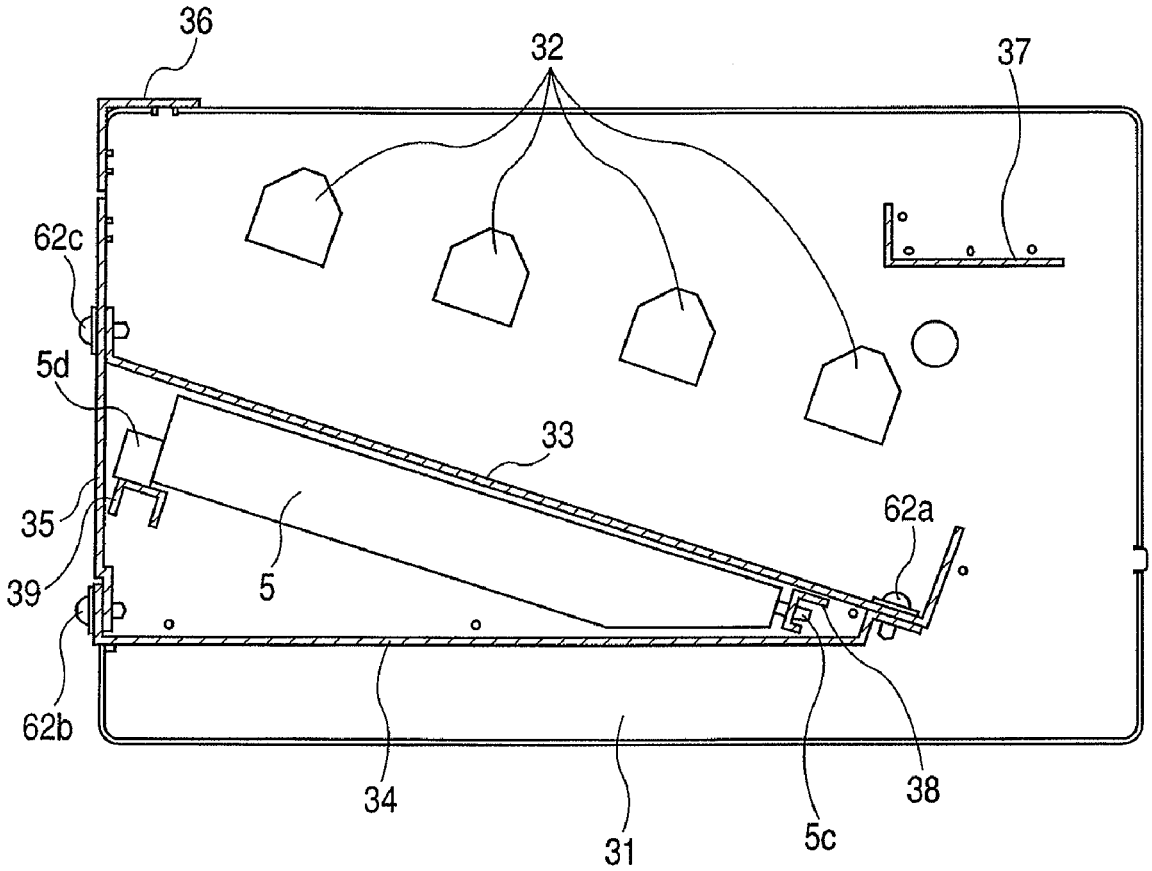
FIG. 5 is a sectional view of a main body frame according to a second embodiment of the present invention.

Further, connection is effected between the support member 33 and the support member 34, between the support member 34 and the support member 35, and between the support member 35 and the support member 33 by screws 62*a*, 62*b*, and 62*c*, respectively, whereby a closed space of a triangular sectional configuration is formed by the front side plate (first side plate) 30, the rear side plate (second side plate) 31, the support member (first support member) 33, the support member (second support member) 34, and the support member (third support member) 35 (FIG. 5). Further, the laser scanner device 5 as the exposure unit is arranged inside the closed space thus formed.

The structure of cutout portions 32 formed in the front side plate 30 and the rear side plate 31, and the method of mounting the process cartridges to the front side plate 30 and the rear side plate 31 are the same as those of the first embodiment, so a redundant description thereof is omitted.

In the first embodiment described above, the bearing surfaces 5*a* and 5*b* are formed at the end portions of the laser scanner device 5, and the laser scanner device 5 is fixed to the support member 23 by four screws.

In this embodiment, in contrast, the laser scanner device 5 is not fixed to the support member 33 but is fixed to scanner support members (exposure unit support members) 38 and 39 for supporting the laser scanner device 5 provided separately within the closed space (see FIGS. 5 and 7). Like the support members 33, 34, 35, 36, and 37, the scanner support members 38 and 39 are fastened at both ends to the front side plate 30 and the rear side plate 31 by screws.

More specifically, the laser scanner device 5 has two protrusions 5*c* arranged respectively on the front side and the depth side thereof in FIG. 5, and one protrusion 5*d* is provided on the side opposite to the protrusions 5*c*, and the protrusions 5*c* are fixed to the scanner support member 38, with the protrusion 5*d* being fixed to the scanner support member 39. When fixing the protrusions 5*c* and 5*d* to the scanner support members 38 and 39, the protrusions are urged by elastic members such as springs (not shown) to thereby fix the protrusions 5*c* and 5*d* to the scanner support members 38 and 39.

With this construction, the laser scanner device 5 and the scanner support members 38 and 39 are not brought into contact with the support member 33, the support member 34, and the support member 35 forming the closed space. Thus, even when the support members 33, 34, and 35 are deflected due to vibration or the like generated when the image forming apparatus is driven, the laser scanner device 5 is not affected by such deflection, so it is possible to maintain the positional relationship for the laser scanner device 5 with high precision.

Further, the scanner support members 38 and 39, which support the laser scanner device 5, are fastened to the front side plate 30 and the rear side plate 31. Thus, due to the provision of the scanner support members 38 and 39, it is possible to further enhance the rigidity of the main body frame, and it is possible to effectively suppress positional deviation of the laser scanner device 5 attributable to twisting of the front side plate 30 and the rear side plate 31.

With this construction, it is possible to maintain high exposure precision for the laser scanner device 5, so it is possible to obtain a high quality image.

Further, since the laser scanner device 5 is provided inside the closed space, the closed space does not constitute a dead space, so it is possible to prevent an increase in size of the image forming apparatus due to the formation of the closed space.

Further, as illustrated in FIG. 6, of the support members forming the closed space, the support member 33 arranged between the laser scanner device 5 and the photosensitive drums to which laser beams are applied is provided with slit portions 33*a* for allowing passage of the laser beams. The laser beams emitted from the laser scanner device 5 pass through the slit portions 33*a* to be applied to the photosensitive drums.

Further, in this embodiment, the support member 33 is arranged so as to be parallel to the direction in which the process cartridges are arranged (i.e., obliquely with respect to the installment surface of the apparatus main body) (see FIG. 5). With this construction, no unnecessary space is formed between the process cartridges and the support member 33. Thus, it is possible to achieve a reduction in size of the image forming apparatus main body.

In this way, the arrangement direction, configuration, etc. of the support members forming the closed space are set taking into consideration the configuration, arrangement direction, etc. of the members arranged outside the closed space, whereby no unnecessary space is generated within the main body frame, so it is possible to prevent an increase in size of the image forming apparatus main body.

While in this embodiment the laser scanner device 5 is fixed to the scanner support members 38 and 39, it is also possible to adopt a construction in which, instead of providing the scanner support members 38 and 39, protrusions are formed on the laser scanner device 5 and mounted to the front side plate 30 and the rear side plate 31.

With this construction also, the laser scanner device 5 is not brought into contact with the support member 33, the support member 34, and the support member 35 forming the closed space. Thus, even when the support members 33, 34, and 35 are deflected due to vibration or the like generated when the image forming apparatus is driven, the laser scanner device 5 is not affected by such vibration, and it is possible to accurately maintain the positional relationship for the laser scanner 5.

While in this embodiment four photosensitive drums are provided as the image bearing members, the number of photosensitive drums is not restricted to four; it is only necessary that at least one photosensitive drum be provided within the apparatus main body.

As described above, according to this embodiment, it is possible to provide an image forming apparatus capable of preventing an increase in size of the image forming apparatus main body and positional deviation of the optical component due to twisting of the side plates while providing a closed space in the main body frame.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-160033, filed Jun. 18, 2007, which is hereby incorporated by reference herein in its entirety.

What is claimed is:

1. An image forming apparatus comprising:

an exposure unit that exposes an image bearing member by a laser beam;

a first side plate and a second side plate facing with each other;

a first support member, a second support member, and a third, support member connecting the first side plate and the second side plate to each other, and an exposure unit support member connecting the first side plate and the second side plate to each other without coming into contact with the first support member, the second support member, and the third support member, with the exposure unit being mounted to the exposure unit support member, wherein the first side plate and the second side plate and the first support member, the second support member, and the third support member form a substantially closed space, wherein a whole of said exposure unit is arranged in the closed space, and wherein a section of the closed space on a plane parallel to the first side plate and the second side plate has a substantially triangular shape.

2. An image forming apparatus according to claim 1, wherein the image bearing member comprises a plurality of image bearing members, and wherein the first support member provided between the exposure unit and the plurality of image bearing members is parallel to an aligning direction of the plurality of the image bearing members.

* * * * *